US011421428B2

(12) United States Patent
Böttcher et al.

(10) Patent No.: US 11,421,428 B2
(45) Date of Patent: Aug. 23, 2022

(54) FLOATING FLOOR SYSTEM

(71) Applicants: LOW & BONAR B.V., Arnhem (NL); LOW & BONAR GERMANY GMBH & CO. KG, Erlenbach (DE)

(72) Inventors: Rolf-Dieter Böttcher, Kleve (DE); Alexander Siebel, Aachen (DE); Jan Mahy, Arnhem (NL)

(73) Assignee: Econcore N.V., Leuven (BE)

( * ) Notice: Subject to any disclaimer, the term of this patent is extended or adjusted under 35 U.S.C. 154(b) by 0 days.

(21) Appl. No.: 17/256,825

(22) PCT Filed: Jul. 3, 2019

(86) PCT No.: PCT/EP2019/067860
§ 371 (c)(1),
(2) Date: Dec. 29, 2020

(87) PCT Pub. No.: WO2020/007918
PCT Pub. Date: Jan. 9, 2020

(65) Prior Publication Data

US 2021/0108424 A1 Apr. 15, 2021

(30) Foreign Application Priority Data

Jul. 5, 2018 (WO) ..... PCT/EP2018/068239

(51) Int. Cl.
*E04F 15/18* (2006.01)
*E04F 15/12* (2006.01)
*E04F 15/20* (2006.01)

(52) U.S. Cl.
CPC ..... *E04F 15/182* (2013.01); *E04F 15/123* (2013.01); *E04F 15/186* (2013.01); *E04F 15/203* (2013.01)

(58) Field of Classification Search
CPC ..... E04F 15/182; E04F 15/123; E04F 15/186; E04F 15/203; E04F 15/18; E04F 15/185;
(Continued)

(56) References Cited

U.S. PATENT DOCUMENTS 2,910,396 A * 10/1959 Frobisher ..... B28B 19/0092 428/118
3,388,516 A * 6/1968 Thielen ..... E04F 15/18 52/393

(Continued)

FOREIGN PATENT DOCUMENTS

CN 101084108 A 12/2007
CN 101755098 A 6/2010

(Continued)

OTHER PUBLICATIONS

Oct. 22, 2019 International Search Report issued in International Patent Application No. PCT/EP2019/067860.

(Continued)

*Primary Examiner* — James M Ference
(74) *Attorney, Agent, or Firm* — Hamre, Schumann, Mueller & Larson, P.C.

(57) ABSTRACT

A composite structure for a floating floor system including at least one layer of force muting material and a layer of formwork, wherein the layer of formwork is located on the at least one layer of force muting material wherein the layer of formwork is a half closed folded honeycomb structure or a relaxed honeycomb structure.

13 Claims, 4 Drawing Sheets

Figure 1:
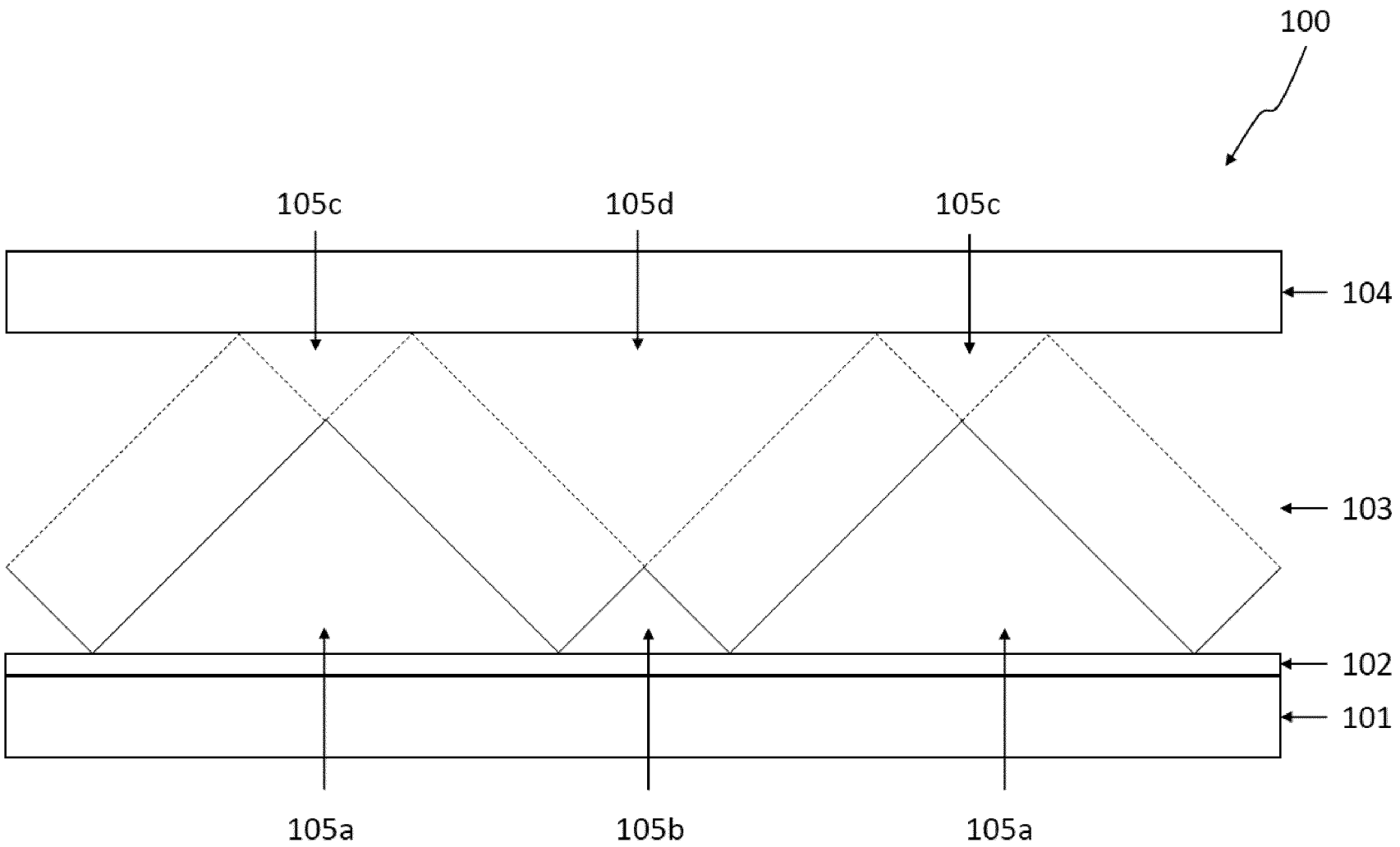

(58) Field of Classification Search
CPC ..... E04F 15/20; E04F 15/206; E04F 15/225; E04F 2290/041; E04F 2290/044; E04B 2001/8414; E04B 2001/8254; E04B 2001/8263; E04B 2001/8281; E04B 2001/748; Y10T 428/24149; Y10T 428/24165
See application file for complete search history.

(56) References Cited

U.S. PATENT DOCUMENTS

| | | | | |
|---|---|---|---|---|
| 4,425,981 | A * | 1/1984 | Kiesewetter | E01F 8/0035 181/286 |
| 4,522,284 | A | 6/1985 | Fearon et al. | |
| 4,637,184 | A | 1/1987 | Radtke et al. | |
| 4,685,259 | A | 8/1987 | Eberhart et al. | |
| 4,860,506 | A | 8/1989 | Yoshimi et al. | |
| 5,619,832 | A | 4/1997 | Myrvold | |
| 8,663,523 | B2 * | 3/2014 | Bradford | B29C 53/063 264/177.12 |
| 8,668,855 | B2 * | 3/2014 | Bradford | B29C 48/11 264/177.12 |
| 8,888,941 | B2 * | 11/2014 | Bradford | B29C 48/0021 156/204 |
| 2003/0172600 | A1 * | 9/2003 | Choi | E04F 15/20 52/144 |
| 2005/0031832 | A1 * | 2/2005 | Kannankeril | B32B 15/20 428/178 |
| 2005/0106378 | A1 * | 5/2005 | Rives | E04F 15/182 428/304.4 |
| 2006/0230699 | A1 | 10/2006 | Keene | |
| 2012/0055108 | A1 * | 3/2012 | Bierwirth | E04F 15/182 52/403.1 |
| 2017/0114551 | A1 * | 4/2017 | Sennik | E04F 15/186 |
| 2018/0223545 | A1 * | 8/2018 | Stopper | E04F 15/185 |
| 2020/0308850 | A1 * | 10/2020 | Igo | E04F 15/185 |
| 2021/0108424 | A1 | 4/2021 | Böttcher et al. | |

FOREIGN PATENT DOCUMENTS

| | | | |
|---|---|---|---|
| CN | 204212354 | U | 3/2015 |
| CN | 204826537 | U | 12/2015 |
| DE | 19901086 | A1 | 7/2000 |
| DE | 102009009088 | A1 | 8/2010 |
| EP | 0057372 | A1 | 8/1982 |
| WO | 2006/053407 | A1 | 5/2006 |
| WO | 2017023242 | A1 | 2/2017 |

OTHER PUBLICATIONS

Oct. 22, 2019 Written Opinion issued in International Patent Application No. PCT/EP2019/067860.
Office Action issued in corresponding Chinese Application No. 201980044851.7, dated Mar. 3, 2022, with English translation.

* cited by examiner

FLOATING FLOOR SYSTEM

The invention pertains to composite structures for a floating floor system for reducing impact sound, to floating floor systems comprising said composite structures, and to methods for producing said floating floor systems.

Impact sounds occur in multistoried apartments or buildings in the room directly below by for example a walking human, or an object falling on the floor or electrical devices such as a dish washer or a washer.

The impact sound can reach moderate to high noises, thus, the impact sound is highly disturbing for people in the room directly below the impact sound source, especially in the case the impact sound has a frequency below 250 Hz.

Therefore, a lot of effort was made for impact sound insulation, in the past. There are two main solutions proposed, which lead until now to reduce the impact sound.

The first solution is to increase the load on a floor slab by increasing the weight of a layer of floating screed and the second solution is to introduce an insulation layer between the floor slab and the layer of floating screed. This insulation layer decouples the layer of floating screed and the floor slab so that the impact sound cannot be transmitted directly and the transmission of impact sound is reduced.

But, if the impact sound has a frequency below the resonance frequency, the sound waves will still be transmitted through the insulation layer to the floor slab, thus, the floor slab is exited and the insulating feature of the insulating layer is reduced, in particular at frequencies below 250 Hz.

The resonance frequency is a frequency wherein the sound absorption collapses, because the wave length of the air sound is equal to the bending wave of a building component.

Accordingly, in high quality multistoried apartments and buildings, a sufficient impact sound insulation has to be provided for a comfortable noise level, thus, there is a high demand for sufficient impact sound insulating materials and systems.

DE 199 01 086 A1 discloses a sound absorbing system for ceilings in buildings, especially for wooden ceilings. The sound absorbing system comprises a floor slab, an insulating layer comprising void volumes, on the floor slab, and a structure comprising two sandwich floating screed plates and a core, wherein the core comprises low density material, and a wooden cover plate on the insulating layer. The low density material of the core provides high void volumes and these void volumes are connected to the void volumes of the insulating layer.

U.S. Pat. No. 4,860,506 discloses a floor panel for floating floor comprising floor panels elastically supported by buffer members laid on a floor framing and the panels are provided with a plurality of through holes and supporting means integrally united to the underside of the panels at proper intervals. Therefore, the void volumes of the floor panel are connected to each other to prevent compression and expansion of the air.

DE 10 2009 009 088 A1 discloses a sound absorbing system for building ceilings, in particular for wooden ceilings. The sound absorbing system comprises a layer of floating screed and a sound absorbing area, which is between the floor slab and the floating screed. The absorbing area comprises at least one airflow channel with a fluid resistance of at most 5 $kPa \cdot s \cdot m^{-2}$. This sound absorbing system is able to reduce the noise of impact sound at frequencies below 250 Hz by at most 15 dB.

U.S. Pat. No. 4,685,259 discloses a sound rated flooring comprising a composite panel structure including multiple layers. The composite panel comprises a core and at least one acoustically semi-transparent facing of fibrous material which is bonded to the core. The core can be a walled structure such as a honeycomb structure made of cardboard, kraft paper or aluminum. The cells of the honeycomb structure are open to a first side and to a second side.

US 2006/0230699 A1 discloses a sound control flooring system, which comprises a first layer and a second layer of sound absorbing material disposed on a subfloor assembly. The first layer can be a highly porous three dimensional matrix filamentous mat, a honeycomb structure made of cardboard, kraft paper or aluminum, as described in U.S. Pat. No. 4,685,259, or a plastic mat having projections. The second layer can be a plastic mat having a plurality of conical, dimple like, an/or cuspated projections extending therefrom.

EP 0 057 372 A1 discloses a hollow floor comprising a composite of a profiled material, a metal sheet and a thermal insulating layer.

Impact sound absorbing systems of the prior art can absorb impact sound of frequencies above 250 Hz with simple measures, which are well known in the art. But, for absorbing impact sound of frequencies below 250 Hz, less options are available, even options with low absorbing properties.

The object of the present application is to provide a composite structure for a floating floor system, a floating floor system and a method for providing a floating floor system, which eliminates or at least reduces the drawbacks of the prior art and provides sound absorbing properties at low frequencies.

The object is reached by the composite structure according to claim 1, the floating floor system according to claim 9 and the method for providing a floating floor system according to claim 11.

The composite structure for a floating floor system comprises at least one layer of force muting material and a layer of formwork, wherein the layer of formwork is located on the at least one layer of force muting material, characterized in that the layer of formwork is a half closed folded honeycomb structure or a relaxed honeycomb structure.

Surprisingly, it has been found that the composite structure reduces the impact sound in floating floor systems at low frequencies, such as frequencies below 250 Hz.

The composite structure preferably has a resonance frequency below 250 Hz, preferably below 150 Hz, more preferably below 100 Hz, even more preferably below 80 Hz and most preferably below 50 Hz. Accordingly, the impact sound in floating floor systems is reduced at low frequencies, in particular at a frequency below 250 Hz, preferably below 150 Hz, more preferably below 100 Hz, even more preferably below 80 Hz and most preferably below 50 Hz.

The layer of formwork is a three-dimensional layer and comprises a three dimensional structure. Due to the three dimensional structure of the layer of formwork void volumes can be established on a side of the formwork, which is faced to the at least one layer of force muting material, and/or on a side of the formwork, which is not faced to the at least one layer of force muting material. Preferably, the established void volumes on one side of the layer of formwork are connected together, and/or the void volumes on the other side of the layer of formwork are connected together. But, the void volumes of one side and of the other side are not connected through the layer of formwork. The connected void volumes provide at least one air flow channel.

Figure 4:
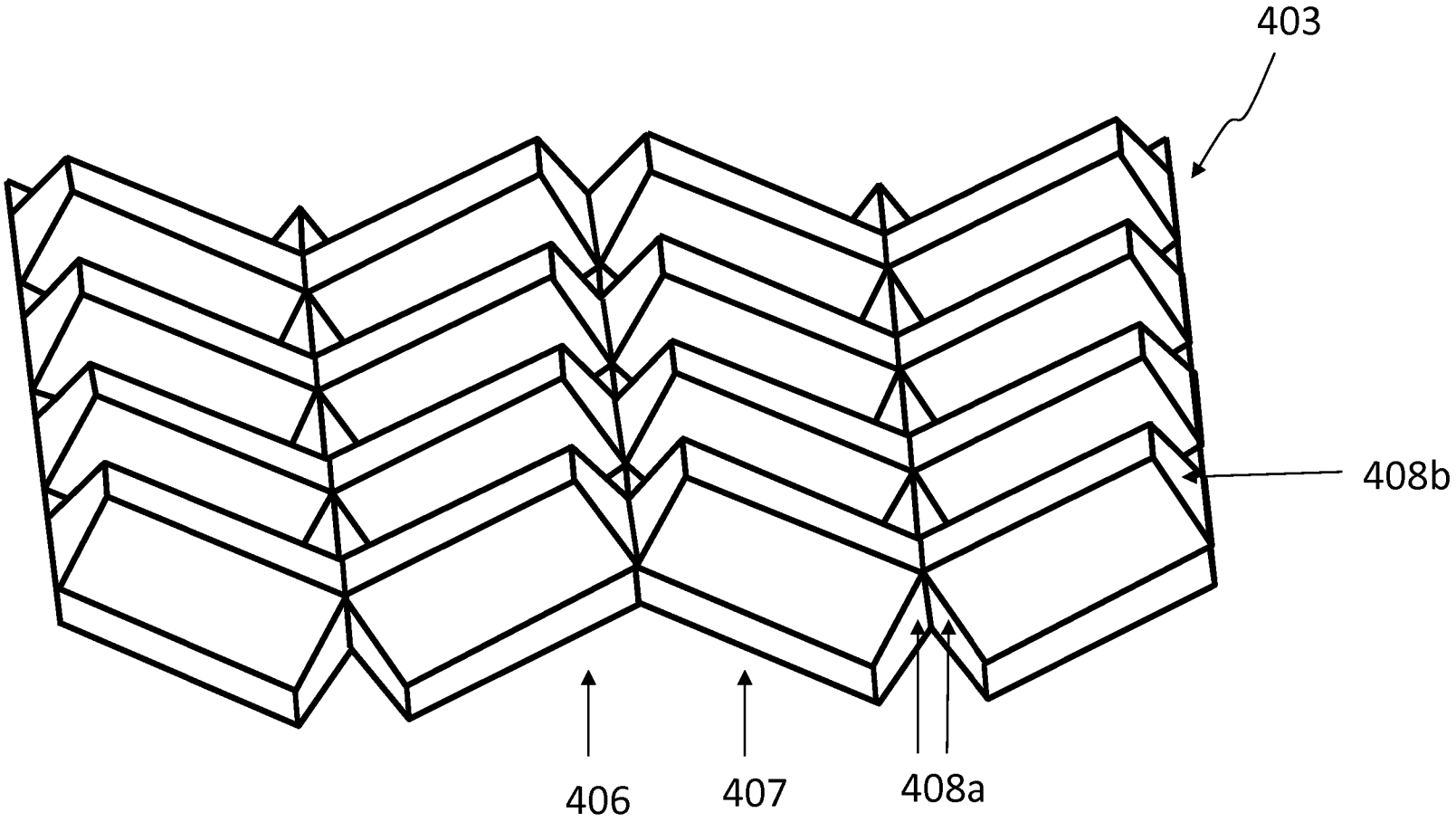

The layer of formwork can be a half closed folded honeycomb structure, such as for example disclosed by WO 2006/053407 A1. This half closed folded honeycomb structure can be produced from a continuous film, which can be composed of a thermoplastic polymer or thermoplastic elastomeric polymer, by plastic deformation perpendicular to the plane of the material such that three-dimensional (3D) structures and connection areas are formed, i.e. half-hexagonal cell walls and small connection areas are formed (FIG. 4). Subsequently, the 3D-structures are folded towards each other to form cells having cell walls adjoin one another in the form of a honeycomb cell.

Preferably, the formed honeycomb cells are closed at one end of the honeycomb cell, such that the honeycomb structure is water and/or gas impermeable over its entire extension and the void on one side of the layer of formwork are not connected void volumes on the other side of the layer of formwork.

Alternatively, the formed honeycomb cells exhibit holes at one ends or are open at the ends, such that the void volumes on one side of the layer of form work are connected with the void volumes of the other side.

The layer of formwork can also be a relaxed honeycomb structure. This relaxed honeycomb structure is produced in the same manner as the half closed folded honeycomb structure with the exception that the folding of the plastically deformed film is stopped before the half hexagonal cell walls meet together to form the honeycomb structure.

As the folding of the plastically deformed film is stopped before the cell walls meet together, the half hexagonal cell walls are at an angle $\alpha$ to each other.

Due to the fact that the relaxed honeycomb structure is manufactured in the same manner as the half closed folded honeycomb structure, the plastically deformed film also comprises 3D-structures and connection areas such that the relaxed honeycomb structure is also water impermeable and the void volumes on one side of the layer of formwork are not connected void volumes on the other side of the layer of formwork.

The composite structure preferably has a dynamic stiffness less than 15 $MN/m^3$, more preferably less than 10 $MN/m^3$, even more preferably less than 5 $MN/m^3$, as determined in accordance with EN 29052:1992, wherein the composite structure preferably comprises a layer of formwork having a thickness of at most 20 mm, preferably of at most 19 mm, more preferably of at most 18 mm, even more preferably at most 17 mm, and most preferably of at most 16 mm.

The at least one layer of force muting material can be a two-dimensional (2D) layer and may consists of a material selected from a group comprising a woven, a spunbonded or spun laid nonwoven, a melt blown nonwoven, a carded nonwoven, an air laid nonwoven, a wet laid nonwoven, a high loft nonwoven comprising fibers having a vertical orientation, such as for example a V-lapped nonwoven, a knitted fabric, a net, a scrim, a two-dimensional mat of extruded entangled filaments, a consolidated layer of unidirectional fibers, a layer of foam material and a layer of rubber.

The woven, nonwovens, knitted fabric, net and scrim may comprise natural fibers, such as for example hemp, jute or flax fibers, mineral fibers, such as for example glass, basalt or rockwool fibers, or fibers made of synthetic polymers.

Preferably, the woven, nonwovens, knitted fabric, net and scrim are composed of synthetic polymers or mineral fibers, more preferably composed of a thermoplastic polymer and/or a thermoplastic elastomeric polymer.

In a preferred embodiment, the woven, nonwovens, knitted fabric, net and scrim are composed of a thermoplastic polymer selected from a group consisting of polyolefins, in particular polyethylene or polypropylene, polyesters, in particular polyethylene terephthalate, polytrimethylene terephthalate, polybutylene terephthalate or polyetylene-1,2-furandicaboxylate, polyamides, in particular polyamide 6 or polyamide 6,6, polyetherketones, polyetheretherketones, polyetherketoneketones, polyethers, polyetheresters, copolymers and mixtures thereof.

The at least one layer of force muting material can also be a three-dimensional structured mat of entangled filaments. Preferably, the filaments of the three-dimensional structured mat of entangled filaments are extruded polymeric filaments. A three-dimensional structured mat of extruded entangled filaments may be provided by any suitable process. Preferably, the three-dimensional structured mat of extruded entangled filaments is provided by extruding polymeric filaments and collecting the extruded filaments into a three-dimensional structure by allowing the filaments to bend, to entangle and to come into contact with each other, preferably in a still molten state. Bending and entangling of the extruded filaments are preferably initiated by collecting the filaments onto a profiled surface, which defines the structure of the three-dimensional structured mat of extruded entangled filaments. Preferably, the surface on which the filaments are collected is profiled such that the three-dimensional structured mat of filaments is shaped into a three-dimensional form which comprises hills and valleys, hemispheres, positive and/or negative cuspates, cups and/or waffles, pyramids, U-grooves, V-grooves, cones and/or cylinders capped with a hemisphere.

Preferably, the polymeric filaments of the three-dimensional structured mat of entangled filaments are composed of a thermoplastic polymer and/or a thermoplastic elastomeric polymer.

In a preferred embodiment, the polymeric filaments of the three-dimensional structured mat of entangled filaments are composed of a thermoplastic polymer and/or a thermoplastic elastomeric polymer, preferably the polymeric filaments are composed of a thermoplastic polymer selected from a group consisting of polyolefins, in particular polyethylene or polypropylene, polyesters, in particular polyethylene terephthalate, polytrimethylene terephthalate, polybutylene terephthalate or polyetylene-1,2-furandicaboxylate, polyamides, in particular polyamide 6 or polyamide 6,6, polyetherketones, polyetheretherketones, polyetherketoneketones, polyethers, polyetheresters, copolymers and mixtures thereof.

The composite structure comprises at least one layer of force muting material. In the case that the composite structure comprises more than one layer of force muting materials, the layers can be composed of the same type of material or of different types of materials.

The composite structure preferably comprises a contact area between the layer of formwork and the layer of force muting material in view of the entire surface of the floating floor system that is at most 1:2, preferably at most 1:5, even more preferably at most 1:10, which enables to use harder materials for the at least one layer of force muting material thereby providing improved long term shape stability of the at least one layer of force muting material, thus increasing the lifetime of the composite structure and the floating floor system.

Not being bound to theory, it is believed that by reducing the contact area between the layer of formwork and the at least one layer of force muting material leads to a higher effective mass per surface area, thus, increasing the force which is applied at the contact areas to the layer of force muting material, leading to absorbing of impact sound at frequencies below 250 Hz.

The impact sound reduction performance of the floating floor system can be further improved by reducing the stiffness of the at least one layer of force muting material.

In an embodiment, the material of the at least one layer of force muting material may comprise fibers. Within the scope of the present invention it is understood that the term fibers refers to both staple fibers and filaments. Staple fibers are fibers which have a specified, relatively short length in the range of 2 to 200 mm. Filaments are fibers having a length of more than 200 mm, preferably more than 500 mm, more preferably more than 1000 mm. Filaments may even be virtually endless, for example when formed by continuous extrusion and spinning of a filament through a spinning hole in a spinneret.

The fibers of the at least one layer of force muting material can comprise mono-component fibers as well as bicomponent fibers, wherein the bicomponent fibers may be of a side-by-side model, concentric or eccentric core/sheath model or islands-in-the-sea model.

In a preferred embodiment, the fibers of the at least one layer of force muting material are bicomponent fibers of the core/sheath model, wherein the sheath and the core can be composed of two polymers which can have the same chemical structure or the sheath and the core can be composed of different polymers of different chemical structures.

By using a bicomponent fiber comprising different polymers, the bicomponent fiber is able to combine the properties of a certain tensile strength of the core as well as a certain bonding strength between the fibers in view of the at least partially melted sheath.

For the core and the sheath of the bicomponent fibers, any suitable polymer can be used, as long as the sheath polymer has a melting temperature which is lower than the melting temperature of the core polymer. Preferably, the core and the sheath of the bicomponent fibers are composed of a thermoplastic polymer and/or a thermoplastic elastomeric polymer.

Preferably, the core of the bicomponent filament is composed of a thermoplastic polymer selected from a group consisting of polyolefins, in particular polyethylene or polypropylene, polyesters, in particular polyethylene terephthalate, polytrimethylene terephthalate, polybutylene terephthalate or polyetylene-1,2-furandicaboxylate, polyamides, in particular polyamide 6 or polyamide 6,6, polyetherketones, polyetheretherketones, polyetherketoneketones, polyethers, polyetheresters, copolymers and mixtures thereof.

In a further preferred embodiment, the sheath of the bicomponent filament is composed of a thermoplastic polymer selected from a group consisting of polyolefins, in particular polyethylene or polypropylene, polyesters, in particular polyethylene terephthalate, polytrimethylene terephthalate, polybutylene terephthalate or polyetylene-1,2-furandicaboxylate, polyamides, in particular polyamide 6 or polyamide 6,6, polyetherketones, polyetheretherketones, polyetherketoneketones, polyethers, polyetheresters, copolymers and mixtures thereof.

In an embodiment, the at least one layer of force muting material has a thickness of at most 10 mm, preferably of at most 9 mm, more preferably of at most 8 mm, even more preferably at most 7 mm, and most preferably of at most 6 mm.

In another embodiment, the at least one layer of force muting material has a thickness of at least at least 1 mm, preferably of at least 2 mm, more preferably at least 3 mm, even more preferably of at least 4 mm, and most preferably of at least 5 mm.

In a preferred embodiment, the at least one layer of force muting material has a weight of at least 100 g/m$^2$, preferably of at least 200 g/m$^2$, more preferably of at least 300 g/m$^2$, even more preferably of at least 400 g/m$^2$, and most preferably of at least 500 g/m$^2$.

Without being bound to theory, it is believed that the higher the weight of the at least one force muting layer is the better is the force muting behavior. However, with higher weight of the at least one force muting layer, also the costs increase, such that the weight of the at least one force muting layer may be lower than 3000 g/m$^2$, preferably lower than 2500 g/m$^2$, more preferably lower than 2000 g/m$^2$, even more preferably lower than 1500 g/m$^2$, and most preferably lower than 1000 g/m$^2$.

The thickness of the at least one layer of force muting material is determined according to DIN EN ISO 9073-2 (October 1996) with an applied pressure of 5 cN/cm$^2$ (0.5 kPa). The pressure is applied onto a pressure foot of 25 cm$^2$, if the at least one layer of force muting material is a woven, a spunbonded or spun laid nonwoven, a melt blown nonwoven, a carded nonwoven, an air laid nonwoven, a wet laid nonwoven, a knitted fabric, a net, a scrim, a two-dimensional mat of extruded entangled filaments, or a consolidated layer of unidirectional fibers. If the at least one layer of force muting material is a layer of foam material, a layer of rubber or a three-dimensional structured mat of entangled filaments, the thickness is determined according to DIN EN ISO 9863-1 (2002) with an applied pressure of 20 cN/cm$^2$ (2 kPa), the pressure being applied onto a pressure foot of 25 cm$^2$.

In the composite structure the at least one layer of force muting material can be present as a continuous layer over the whole extension of the composite structure or as a patterned layer, wherein the force muting material of the at least one layer of force muting material is only present where the layer of formwork is in contact with the at least one layer of force muting material.

If the at least one layer of force muting material is present as a patterned layer, it reduces the amount of material and also the costs of the composite structure. If the at least one layer of force muting material is present as a patterned layer, the composite structure has an improved ability to be rolled up such that the composite structure can be easier handled, stored, transported, sold and installed.

In a preferred embodiment, the at least one layer of force muting material can be bonded to the layer of formwork by any method known by the person skilled in the art. Preferably, the bonding between the at least one layer of force muting material and the layer of formwork is made thermally, mechanically and/or chemically.

In an embodiment, the layer of formwork has a thickness of at most 50 mm, preferably of at most 35 mm, preferably of at most 20 mm, preferably of at most 19 mm, more preferably of at most 18 mm, even more preferably at most 17 mm, and most preferably of at most 16 mm.

In another embodiment, the layer of formwork has a thickness of at least 3 mm, preferably of at least 5 mm, more preferable at least 7 mm, even more preferably of at least 9 mm, and most preferably of at least 10 mm.

The thickness of the layer of formwork is determined according to DIN EN ISO 9863-1 (2002) with an applied pressure of 20 cN/cm$^2$ (2 kPa), the pressure being applied onto a pressure foot of 25 cm$^2$.

In a preferred embodiment, the layer of formwork consists of a relaxed honeycomb structure, wherein the half hexagonal cell walls are at an angle α to each other between 0° and 110°, preferably between 1° and 110°, more preferably between 20° and 100°, even more preferably between 35° and 95° and most preferably between 50° and 90°.

In another embodiment, the angle α between is at least 0°, preferably at least 1°, more preferably at least 15°, even more preferably at least 30°, even more preferably at least 40° and most preferably at least 50°.

In another embodiment, the angle α between is at most 110°, preferably at most 90°, more preferably at most 85°, even more preferably at most 80°, even more preferably at most 70°, and most preferably at most 65°.

In case of an angle α lager than 110° the stability of the formwork is weakened and may not be able to carry the weight of the floating screed.

The layer of formwork can be composed of any suitable thermoplastic polymer or thermoplastic elastomeric polymer.

Preferably, the layer of formwork is composed of a thermoplastic polymer selected from a group consisting of polyolefins, in particular polyethylene or polypropylene, polyesters, in particular polyethylene terephthalate, polytrimethylene terephthalate, polybutylene terephthalate or polyetylene-1,2-furandicaboxylate, polyamides, in particular polyamide 6 or polyamide 6,6, polyetherketones, polyetheretherketones, polyetherketoneketones, polyethers, polyetheresters, copolymers and mixtures thereof.

In a preferred embodiment, the layer of formwork comprises a cover layer attached to at least one side of the half closed honeycomb structure or the relaxed honeycomb structure.

The cover layer can be a two-dimensional (2D) layer and may consists of a material selected from a group comprising a woven, a spunbonded or spun laid nonwoven, a melt blown nonwoven, a carded nonwoven, an air laid nonwoven, a wet laid nonwoven, a knitted fabric, a net, a scrim, a two-dimensional mat of extruded entangled filaments, a consolidated layer of unidirectional fibers, a continuous film or a combination thereof.

The woven, nonwovens or knitted fabric of the cover layer may comprise mineral fibers, such as for example glass, basalt or rockwool fibers, and/or fibers composed of thermoplastic polymers or thermoplastic elastomeric polymer.

Preferably, the fibers comprises in the cover layer are composed of a thermoplastic polymer or a thermoplastic elastomeric polymer.

The fibers comprised in the cover layer can be mono-component fibers as well as bicomponent fibers, wherein the bicomponent fibers may be of a side-by-side model, concentric or eccentric core/sheath model or islands-in-the-sea model.

In an embodiment, the mono-component fibers comprised in the cover layer are composed of a thermoplastic polymer or a thermoplastic elastomeric polymer.

Preferably, the mono-component fibers comprised in the cover layer are composed of a thermoplastic polymer selected from a group consisting of polyolefins, in particular polyethylene or polypropylene, polyesters, in particular polyethylene terephthalate, polytrimethylene terephthalate, polybutylene terephthalate or polyetylene-1,2-furandicaboxylate, polyamides, in particular polyamide 6 or polyamide 6,6, polyetherketones, polyetheretherketones, polyetherketoneketones, polyethers, polyetheresters, copolymers and mixtures thereof.

In a preferred embodiment, the fibers comprised in the cover layer are bicomponent fibers of the core/sheath model. Preferably, the core and the sheath of the bicomponent fibers comprised in the cover layer are composed of a thermoplastic polymer and/or a thermoplastic elastomeric polymers.

By using bicomponent fibers comprising thermoplastic polymers and/or thermoplastic elastomeric polymers, the bicomponent fibers are able to combine the properties of a certain tensile strength of the core as well as a certain bonding strength between the fibers in view of the at least partially melted sheath.

For the core and the sheath of the bicomponent fibers comprised in the cover layer, any suitable thermoplastic polymer and/or thermoplastic elastomeric polymer can be used. Preferably, the polymer of the sheath has a melting temperature which is lower than the melting temperature of the polymer of the core.

Preferably, the core of the bicomponent fibers comprised in the cover layer is composed of a thermoplastic polymer selected from a group consisting of polyolefins, in particular polyethylene or polypropylene, polyesters, in particular polyethylene terephthalate, polytrimethylene terephthalate, polybutylene terephthalate or polyetylene-1,2-furandicaboxylate, polyamides, in particular polyamide 6 or polyamide 6,6, polyetherketones, polyetheretherketones, polyetherketoneketones, polyethers, polyetheresters, copolymers and mixtures thereof.

Preferably, the sheath of the bicomponent fibers of the cover layer is composed of a thermoplastic polymer selected from a group consisting of polyolefins, in particular polyethylene or polypropylene, polyesters in particular polyethylene terephthalate, polytrimethylene terephthalate, polybutylene terephthalate or polyetylene-1,2-furandicaboxylate, polyamides in particular polyamide 6 or polyamide 6,6, polyetherketones, polyetheretherketones, polyetherketoneketones, polyethers, polyetheresters, copolymers and mixtures thereof.

In a preferred embodiment, the layers of the composite structure is composed of a thermoplastic polymer or a thermoplastic elastomeric polymer. The layers of the composite structure can be composed of different polymers, preferably the layers of the composite structure are composed of one thermoplastic polymer or one thermoplastic elastomeric polymer or of a single polymer family.

Within the scope of the invention, a polymer family has to be understood that the polymers of one family are composed of at least 50% of the same monomeric units.

Preferably, the layers of the composite structure are composed of thermoplastic polymers or thermoplastic elastomeric polymers, which are constituted of at least 50%, preferably of at least 60%, more preferably of at least 70%, even more preferably of at least 80%, even more preferably of at least 90%, even more preferably of at least 95%, and most preferably of at least 100% of the same monomeric units.

As all layers of the composite structure are composed of a thermoplastic polymer or a thermoplastic elastomeric polymer enables that all of the layers in the composite structure can be bonded thermally such that no additional chemical and/or mechanical bonding would be necessary.

In an embodiment, the composite structure is composed of only one thermoplastic polymer or thermoplastic elastomeric polymer. Preferably, the layer of formwork, the cover layer and the at least one layer of force muting material are composed of only one thermoplastic polymer or thermoplastic elastomeric polymer.

Within the scope of the invention, the expression "only one thermoplastic polymer or thermoplastic elastomer" means that also co-polymers of the only one thermoplastic polymer or thermoplastic elastomeric polymer are included.

As all layers of the composite structure are composed of only one thermoplastic polymer or thermoplastic elastomeric polymer enables that recycling of the composite structure after its life time is much easier as the layers of the composite structure do not need to be separated before recycling.

The object of the present application is also solved by a floating floor system comprising the composite structure comprising the features as mentioned before and a layer of floating screed on the side of the layer of formwork which is not faced to the at least one layer of force muting material. The floating floor system provides impact sound absorbing properties at low frequencies below 250 Hz, in particular at a frequency below 250 Hz, preferably below 150 Hz, more preferably below 100 Hz, even more preferably below 80 Hz and most preferably below 50 Hz.

In a preferred embodiment, the layer of floating screed is applied on top of the composite structure, so that the floating screed is in direct contact with a surface of the layer of formwork over the entire surface of the layer of formwork which is not faced to the at least one layer of force muting material, so that on one side of the layer of formwork facing the at least one layer of force muting material air flow channels can be established.

In an embodiment, the layer of floating screed is applied on top of the composite structure, so that on both sides of the layer of formwork air flow channels are established. Preferably, the floating screed is applied as a pre-formed plate to the composite structure.

In a preferred embodiment, the plate of floating screed has a thickness extending over the whole floating floor system. Preferably, the thickness of the plate of the floating screed is constant over the whole extension of the plate of floating screed.

Within the scope of the invention, a constant thickness of the plate of floating screed means that the thickness has a variation of at most ±20% of the average thickness, preferably of at most ±15%, even more preferably of at most ±10%, and most preferably of at most ±5%.

The composite structure enables that in a preferred embodiment the thickness of the layer of floating screed in the floating floor system is at most 4.0 cm, preferably at most 3.5 cm, more preferably at most 3.0 cm, even more preferably at most 2.5 cm, even more preferable at most 2.0 cm, and most preferably at most 1.5 cm.

A thickness of the layer of floating screed of more than 4.0 cm is not preferable due to higher costs and higher weight of the whole floating floor system construction.

The object of the present application is also solved by the following method: A method for producing a floating floor system is provided comprising the steps of supplying a composite structure comprising at least one layer of force muting material and a layer of formwork onto a floor slab, and applying a layer of floating screed on the layer of formwork, characterized in that the layer of formwork is a half closed honeycomb structure or a relaxed honeycomb structure.

The composite structure supplied in the method for producing a floating floor system may comprise any of the features as described above.

The following figures and descriptions of the figures are illustrative examples and should not be understood as limiting features of the present invention.

The floating floor system provided according to the method can also comprise any embodiment of the above mentioned composite structure and/or of the above mentioned floating floor system.

FIG. 1: FIG. 1 shows a schematic side view of an embodiment of the floating floor system.

Figure 2:
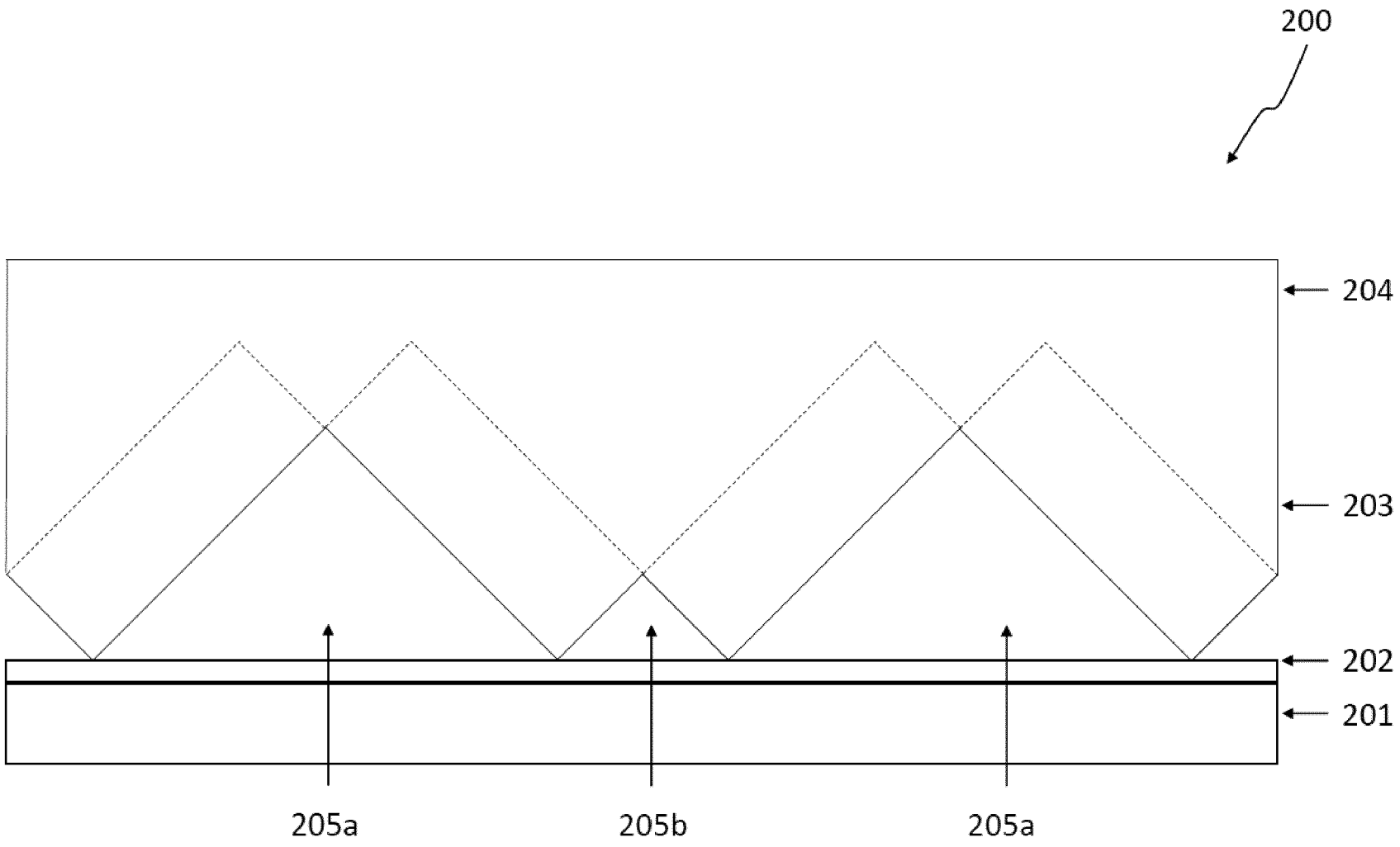

FIG. 2: FIG. 2 shows a schematic side view of another embodiment of the floating floor system.

Figure 3:
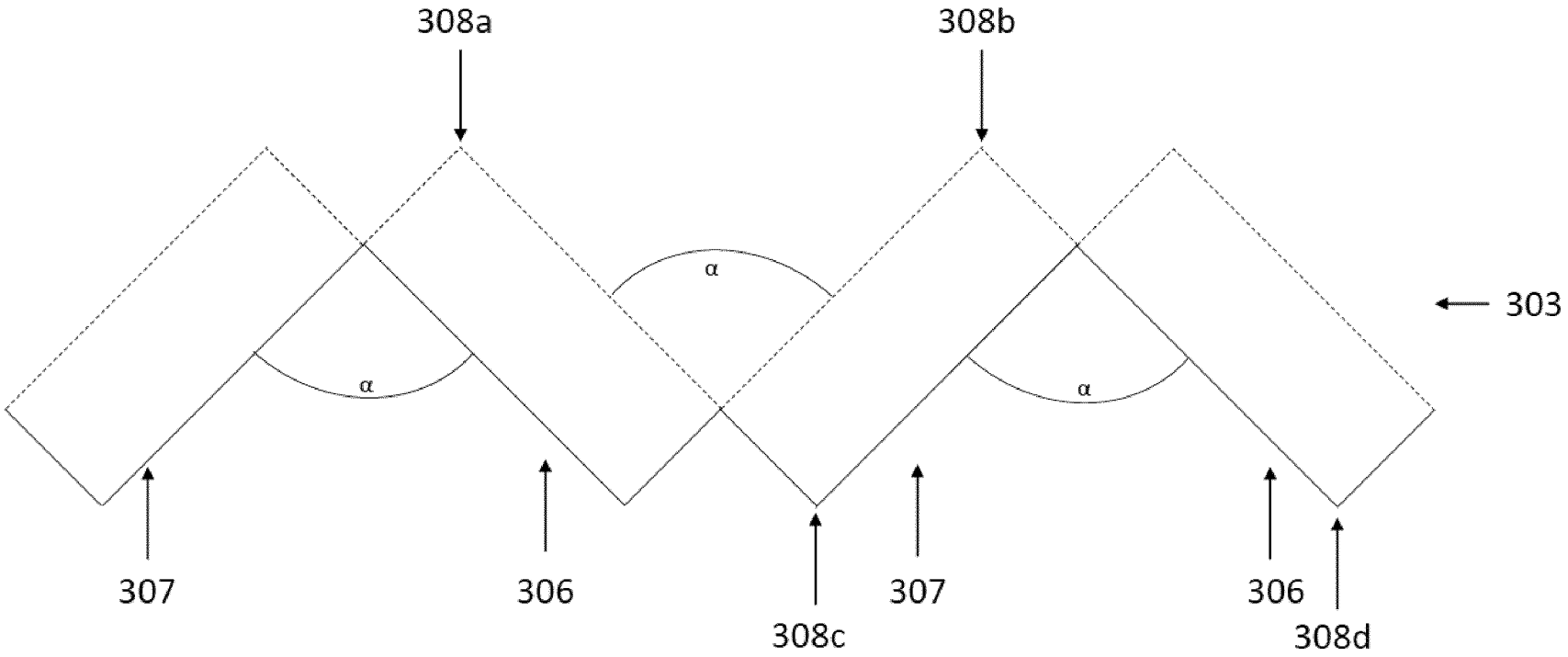

FIG. 3: FIG. 3 shows a schematic side view of a relaxed honeycomb structure.

FIG. 4: FIG. 4 shows a perspective view of a section of a relaxed honeycomb structure.

In FIG. 1 an embodiment of the floating floor system 100 is shown comprising at least one layer of force muting material 102 laying on top of a floor slab 101. A relaxed honeycomb structure 103 as a layer of formwork is supplied on the at least one layer of force muting material 102, further, a layer of floating screed 104 is supplied as a plate on top. By supplying the layers 102, 103 and 104 airflow channels are established in the layer of formwork 103 on the side of the layer of formwork which is facing the layer of force muting material 102 (105*a* and 105*b*) as well as the side of the layer of formwork which is not facing the layer of force muting material 102 (105*c* and 105*d*). The airflow channels 105*a* and 105*b* are connected together (not shown). Also, the air flow channels 105*c* and 105*d* are connected together (not shown).

In FIG. 2 another embodiment of the floating floor system 200 is shown comprising at least one layer of force muting material 202 laying on top of a floor slab 201. A layer of formwork, for example being a relaxed honeycomb structure, 203 is supplied on the at least one layer of force muting material, further, a layer of floating screed 204 is supplied on top of the layer of formwork, wherein the floating screed 204 is in contact with the layer of formwork 203 over the entire surface. By supplying the layers 202, 203 and 204 air flow channels 205*a* and 205*b* are established on the side of the layer of formwork which is facing the layer of force muting material 202. The airflow channels 205*a* and 205*b* are connected together (not shown).

In FIG. 3 a side view of a relaxed honeycomb structure 303 is shown, which has an angle α between two halves of a honeycomb 306 and 307. Thereby, it is possible to open the honeycomb on the upper side 308*a* and 308*b* as well as on the lower side 308*c* and 309*d* to establish the angle α.

In FIG. 4 a perspective view of a relaxed honeycomb structure 403 is shown comprising several half hexagonal cells 406 and 407 and connection areas 408*a* and 408*b*.

EXAMPLE 1

A composite structure for a floating floor system has been provided comprising a foam material having a thickness of 10 mm as a layer of force muting material and a layer of formwork, the layer of formwork consisting of a relaxed honeycomb structure made of polypropylene, wherein the angle α between two halves of a honeycomb is 60°.

The performance of the composite structure has been evaluated according to EN 29052:1992, as shown in Table 1.

TABLE 1

| Example 1 | | | |
|---|---|---|---|
| Sample | Thickness [mm] | $F_R$ [Hz] | S't [MN/m$^3$] |
| 1 | 25 | 37 | 10.8 |
| 2 | 25 | 35 | 9.7 |

TABLE 1-continued

| Example 1 | | | |
|---|---|---|---|
| Sample | Thickness [mm] | $F_R$ [Hz] | S't [MN/m$^3$] |
| 3 | 25 | 36 | 10.2 |
| average | 25 | 36 | 10.2 |

COMPARATIVE EXAMPLE

A foam material having a thickness of 10 mm as a layer of force muting material has been provided without a layer of formwork.

The performance of the layer of foam material has been evaluated according to EN 29052:1992, as shown in Table 2.

TABLE 2

| Comparative example | | | |
|---|---|---|---|
| Sample | Thickness [mm] | $F_R$ [Hz] | S't [MN/m$^3$] |
| 1 | 10 | 70 | 38.7 |
| 2 | 10 | 76 | 45.7 |
| 3 | 10 | 77 | 46.9 |
| average | 10 | 74 | 43.8 |

The composite structure has an average resonance frequency ($F_R$) of 36 Hz, and a dynamic stiffness of 10.2 MN/m$^3$, which is a significant improvement over the layer of foam material having an average resonance frequency ($F_R$) of 74 Hz, and a dynamic stiffness of 43.8 MN/m$^3$ A resonance frequency below 50 Hz is considered to be excellent for impact sound reduction, in particular with a reduced dynamic stiffness.

The invention claimed is:

1. A composite structure for a floating floor system comprising:

at least one layer of force muting material and a layer of formwork, wherein the layer of formwork is located on the at least one layer of force muting material, the at least one layer of force muting material being parallel to a plane and wherein the layer of formwork is a relaxed honeycomb structure, said relaxed honeycomb structure being composed of a thermoplastic polymer or thermoplastic elastomeric polymer, by plastic deformation perpendicular to the plane such that three-dimensional structures and connection areas are formed comprising half hexagonal cell walls and the connection areas are formed, and the three-dimensional-structures being folded towards each other, so that the half hexagonal cell walls are at an angle alpha to each other, the angle alpha being selected from between 20° and 100°, between 35° and 95° and between 50° and 90°, the relaxed honeycomb structure being water impermeable and void volumes on one side of the layer of formwork not being connected to void volumes on the other side of the layer of formwork.

2. The composite structure according to claim 1, wherein the at least one layer of force muting material has a thickness of 1 to 10 mm.

3. The composite structure according to claim 1, wherein the at least one layer of force muting material is composed of a material selected from the group consisting of a woven, a spunbonded or spun laid nonwoven, a melt blown nonwoven, a carded nonwoven, an air laid nonwoven, a wet laid nonwoven, a knitted fabric, a net, a scrim, a two-dimensional mat of extruded entangled filaments, a consolidated layer of unidirectional fibers, a layer of foam material, a layer of rubbermaterial and a three-dimensional structured mat of entangled filaments.

4. The composite structure according to claim 1, wherein the layer of formwork has a thickness of 3 to 20 mm.

5. The composite structure according to claim 1, wherein the layer of formwork comprises a cover layer attached to at least one side of the relaxed honeycomb structure.

6. The composite structure according to claim 5, wherein the cover layer is a two-dimensional layer and optionally consists of or comprises a material selected from the group consisting of a woven, a spunbonded or spun laid nonwoven, a melt blown nonwoven, a carded nonwoven, an air laid nonwoven, a wet laid nonwoven, a knitted fabric, a net, a scrim, a two-dimensional mat of extruded entangled filaments, a consolidated layer of unidirectional fibers, a continuous layer and a combination thereof.

7. The composite structure according to claim 1, wherein the at least one layer of force muting material, the layer of formwork and the cover layer are composed of a thermoplastic polymer and/or a thermoplastic elastomeric polymer.

8. A floating floor system comprising the composite structure according to claim 1 and a layer of floating screed on the side of the layer of formwork which is not faced to the at least one layer of force muting material.

9. The floating floor system according to claim 8, wherein the layer of floating screed has a thickness of at most 4.0 cm.

10. A method for producing a floating floor system, comprising the layers of the floating floor system according to claim 8, the method comprising:

supplying at first the at least one layer of force muting material onto a floor slab, followed by the layer of formwork and finally by the layer of floating screed, wherein the at least one layer of force muting material being parallel to a plane, wherein the layer of formwork is a relaxed honeycomb structure, said relaxed honeycomb structure being produced from a continuous film, which can be composed of a thermoplastic polymer or thermoplastic elastomeric polymer, by plastic deformation perpendicular to the plane of the film such that three-dimensional structures and connection areas are formed, so that half-hexagonal cell walls and small connection areas are formed, and subsequently, the three-dimensional-structures are folded towards each other, so that the half hexagonal cell walls are at an angle alpha to each other, the relaxed honeycomb structure being water impermeable and void volumes on one side of the layer of formwork not being connected to void volumes on the other side of the layer of formwork, wherein the at least one layer of force muting material is parallel to the plane, and the angle alpha is selected from between 200 and 1000, between 350 and 950 and between 500 and 900.

11. The method according to claim 10, wherein the supplying of the at least one layer of force muting material onto a floor slab and the supplying of the layer of formwork is performed by rolling off the layers from a roll onto the floor slab or by laying down pieces of the layers step by step on the floor slab.

12. The method according to claim 11, wherein the supplying of the at least one layer of force muting material onto a floor slab and the supplying of the layer of formwork is performed by rolling off bath layers simultaneously from one roll onto the floor slab.

13. A floating floor system comprising the floating floor system according to claim 8 on wooden floor slab and/or concrete slab.

* * * * *